United States Patent [19]

Carlsson

[11] Patent Number: 4,690,057

[45] Date of Patent: Sep. 1, 1987

[54] HIGH VELOCITY PROJECTILE

[75] Inventor: Gengt Carlsson, Örebro, Sweden

[73] Assignee: AB BOFORS, Bofors, Sweden

[21] Appl. No.: 864,379

[22] Filed: May 19, 1986

[30] Foreign Application Priority Data

May 24, 1986 [SE] Sweden ..... 8502575

[51] Int. Cl.[4] ..... F42C 9/14

[52] U.S. Cl. ..... 102/266; 102/269

[58] Field of Search ..... 102/266, 265, 269, 272, 102/273, 270, 271

[56] References Cited

U.S. PATENT DOCUMENTS

| | | | |
|---|---|---|---|
| 1,169,747 | 1/1916 | Moren | 102/271 X |
| 1,347,716 | 7/1920 | Semple | 102/265 |
| 1,758,635 | 5/1930 | Wieser | 102/265 |
| 3,633,510 | 1/1972 | Bernardin | 102/265 X |

FOREIGN PATENT DOCUMENTS

| | | | |
|---|---|---|---|
| 1578489 | 7/1977 | Fed. Rep. of Germany . | |
| 89503 | 6/1937 | Sweden . | |
| 221821 | 8/1925 | United Kingdom | 102/266 |

*Primary Examiner*—David H. Brown

*Attorney, Agent, or Firm*—Pollock, Vande Sande & Priddy

[57] ABSTRACT

A projectile is provided for penetration into targets of both slight and great resistance to penetration. The projectile is also operative for exploding the payload of the projectile after penetration. The projectile includes a forward barrier of high strength material and a fuse adapted to be detonated on impact with targets. This fuse operates with high sensitivity on impact with targets of slight resistance to penetration and by delayed action which permits explosion of the payload of the projectile after penetration. A delayed action charge included in the fuse is placed behind the barrier and is allocated a protected position where shock waves which occur in the forward material portions of the projectile are prevented from triggering or actuating the delayed action charge. The delayed action charge is exposed to a unit placed between the barrier and the delayed action charge, the unit, when the fuse is detonated, effectuating a reliable ignition of the delayed action charge.

10 Claims, 2 Drawing Figures

HIGH VELOCITY PROJECTILE

TECHNICAL FIELD

The present invention relates to a projectile which is suited for high velocities, for example, 400 m/s and higher. The new projectile is to have a capacity for piercing targets which present both slight and great resistance to piercing. In this instance, the projectile shall be actuable for exploding the payload of the projectile after penetration into the target. Furthermore, the projectile is of the type which includes a forward barrier of high strength material, for example steel. It also includes a fuse which detonates on impact against either type of target and operates either by high sensitivity on impact against a target of slight resistance to piercing, or by delayed action which permits explosion of the payload once the projectile has penetrated into the target.

THE STATE OF THE ART

It is known in the art to provide projectiles which may be exploded on impact against flimsy targets and targets with high resistance to piercing. In such projectiles, the forward barrier is employed to participate in the piercing function. In such instances, the fuse may be considered as consisting of a forward portion (impact member) which is located ahead of the barrier, and a rear portion (activating portion) which is located behind the barrier. The forward portion is sensitive and reacts on impact with flimsy targets. On impact with highly-resistant targets, for example targets with 12 mm armour plating, the forward portion of the fuse is destroyed. This forward portion has no actual function in such cases. The activating portion of the fuse is designed to enter into operation also in this case and to occasion the delayed-action explosion of the payload of the projectile. The rear portion of the fuse functions, thus, on impact with both flimsy targets and on impact with harder targets.

It is crucial that bursting of the projectile does not take place until after total piercing and the projectile has penetrated into the target a distance of approximately 1.5–3 m.

BRIEF DESCRIPTION OF THE INVENTION

1. TECHNICAL PROBLEM

In order to attain the contemplated effect of realizing efficient bursting ignition of the payload of the projectile after penetration of the projectile into the target, it is vital to design the fuse so that exact bursting takes place when desired, and, at the same time, so that unintentional bursting is effectively prevented.

2. SOLUTION

The primary objective of the present invention is to provide an apparatus and arrangement which solves this and other problems A projectile according to the present invention has a fuse including a delayed action charge located behind the barrier and allocated a position such that it is well-protected from being detonated by shock waves produced in the forward material portions of the projectile. Furthermore, the delayed action charge is exposed to a unit placed between the barrier and the delayed action charge, this unit effectuating, on detonation of the fuse, a reliable ignition of the delayed action charge.

In another embodiment of the present invention, it is proposed that the delayed action charge be disposed in a portion of a hollow cylindrical configuration which is yieldingly mounted in the rear portions of the fuse. This mounting may, for example, be realized by means of annular members (O-rings) of elastic material. The mounting is, in this instance, designed such that the hollow cylindrical portion will be resiliently yieldable to both axial and radial movements. In one preferred embodiment, the rear portions of the hollow cylindrical portion rest against a washer of plastic or equivalent material. In such an instance, the washer may be disposed in a space provided for a primer safety device included in the fuse.

In its turn, the hollow cylindrical portion is, to a certain degree, yieldably mounted in a rear portion of the fuse. This rear portion encloses the delayed action charge and the above-mentioned unit, together with the primer safety device and bottom screw with associated driver charge and eye. The rear portion is preferably of lightweight material, for example aluminum. Mutually facing end surfaces of the barrier and the rear portion both are urged against one another by the intermediary of a ring of lead or other soft, yielding material.

In a further preferred embodiment of the present invention, the unit is designed with a nozzle which discharges into a space to which the delayed action charge is connected by the intermediary of an end surface. The unit is operative to transmit gas and thermal energy from forward portions in the fuse so as to realize a prolonged effective ignition impulse for the delayed action charge. This is realised in that the unit generates, by the intermediary of the nozzle, high pressure in the space, which is elevated towards the end of the ignition impulse. The unit may also include its own charge which boosts the energy content of the gases from the forward portions of the fuse. The volume of the space is 1–6 $cm^3$, preferably approximately 3–4 $cm^3$. The diameter of the nozzle is 0.2–0.6 mm, preferably between 0.3 and 0.5 mm.

The impact member of the fuse is preferably designed with two mutually subsequent ignition caps which are in communication with each other via a channel. The leading ignition cap may be detonated by a firing pin in the known manner. The trailing ignition cap is in communication with the unit by the intermediary of a channel which extends through the barrier.

The firing pin is actuated by means of an impact member cooperating with a rod which in turn acts on the firing pin. Cooperation beween the impact member and the rod is effected by the intermediary of a cup-shaped surface on the impact member and a spheroid surface on the rod.

On impact with a flimsy target, the sensitive forward portion of the fuse is activated and this forward portion in turn actuates the rear portions of the fuse by the intermediary of the barrier. On impact with hard targets, the forward portion is destroyed. When the forward portion is destroyed, the rear ignition cap is detonated and, in its turn, detonates the rear portion of the fuse.

3. ADVANTAGES

As a result of the above-proposed improvements, a projectile is provided in which ignition and bursting take place precisely and effectively, irrespective of the type of target. Shock waves in the forward portions of the projectile cannot occasion erroneous triggering of the bursting charge of the projectile.

According to the present invention, the forward portions of the projectile may be of different types of materials, this having a damping effect on the shock waves considered above. Thus, the resiliently mounted delayed action charge is protected by several different means from these shock waves. First, it is resiliently carried in the rear portion of the fuse. In turn, the rear portion is, to a considerable degree, resiliently carried in the barrier. The different material types in the rear portion, barrier and the forward portions of the projectile are included in the protective functions for the delayed action charge. As a result of the specific arrangement with the unit which is provided with the above-dsicussed nozzle, an effective pressure of the ignition gases will be created in the space leading to the ignition surface of the delayed action charge. The ignition impulse for the delayed action charge will be prolonged and pressure elevation will be ensured at the end of the ignition impulse. The booster charge of the unit proper provides a guarantee for a lengthy ignition impulse of the type considered here.

The specific impact member in the nose of the projectile guarantees an efficient impact function even when the angle of impingement between the longitudinal axis of the projectile and the surface of the target is small.

BRIEF DESCRIPTION OF THE ACCOMPANYING DRAWINGS

The nature of the present invention and its significative aspects will be more readily understood from the following brief description of the accompanying Drawings, and discussion of one preferred embodiment relating thereto.

In the accompanying Drawings:

FIG. 1 is a side elevation of a high velocity projectile according to the present invention; and FIG. 2 is a section through forward portions of the projectile, of the present invention, according to FIG. 1.

DESCRIPTION OF PREFERRED EMBODIMENT

Figures 1, 2:
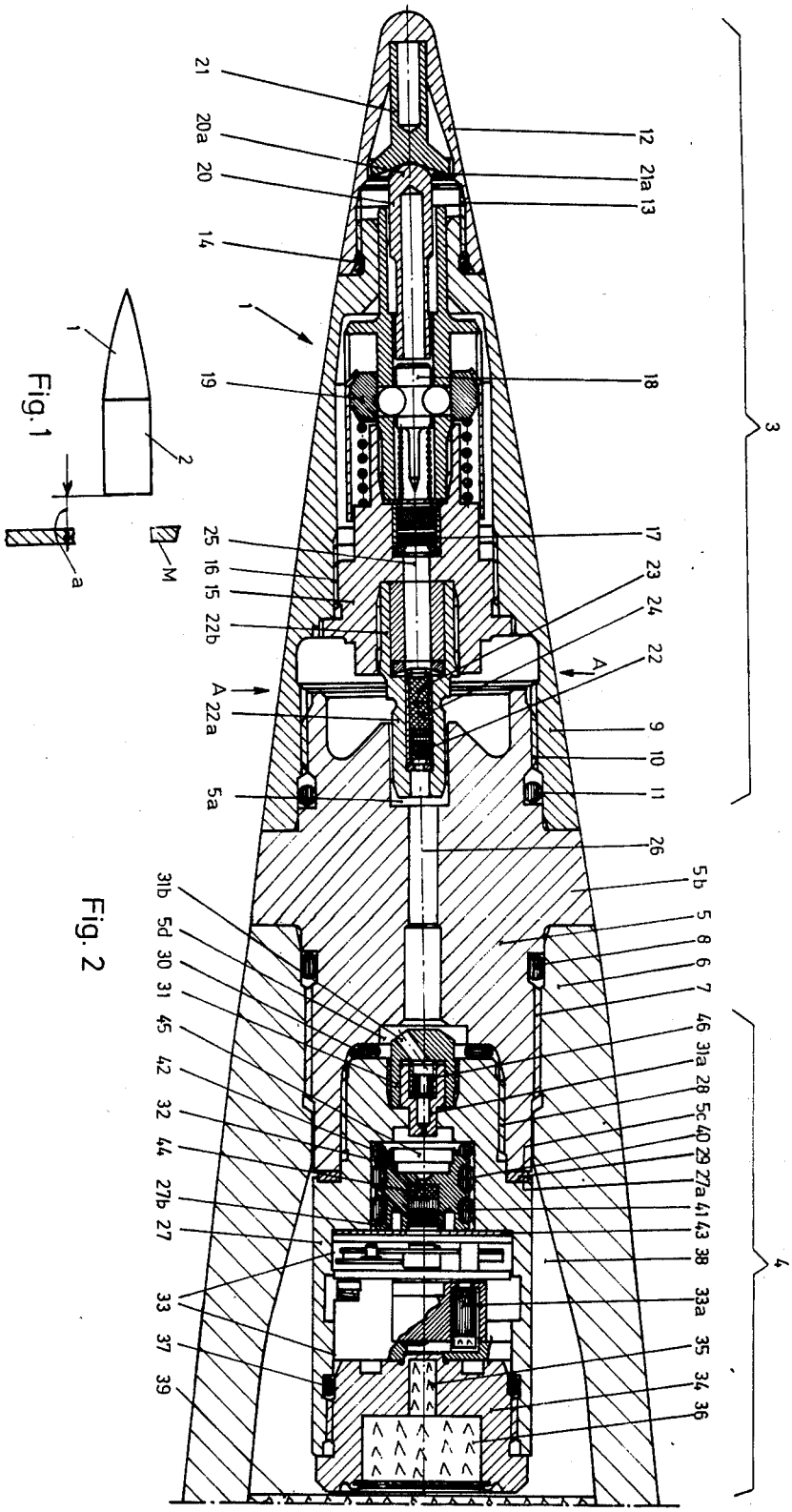

Referring to the Drawings, FIG. 1 shows a high velocity projectile which is intended to have a muzzle-to-target range of the order of magnitude of 20 kilometers. Velocity at kill is between 400 and 500 meters per second. In principle, the projectile has been divided up into two parts, 1 and 2, part 1 being shown in greater detail in FIG. 2. Part 2, which carries the payload, may be of known type.

According to FIG. 2, the fuse function is integrated in the forward region 1 of the projectile. The fuse function may be considered as comprising an impact member 3 and an activating member 4. These members 3 and 4 are separated by a barrier which, in the present embodiment, consists of a tubular body of high strength steel. The impact member 3 is fixed to the barrier via the forward end thereof. The member 4 is fixedly anchored to the barrier 5 at its rear end. The barrier or tubular body 5 is fixedly disposed in the casing 6, for example by threads 7 on the body or the casing, respectively, the casing being moreover sealed by a ring 8 of elastic material. An envelope for the forward portions of the projectile is designated 9. This envelope is of light metal. The envelope 9 is fixed on the tubular body 5, for example by means of threads 10, and sealed by a sealing 11 of a type similar to the sealing 8. The nose cone 12 of the projectile is screwed to the forward portions of the envelope 9 by threads 13. The nose cone may be of light metal or equivalent material. A sealing 14 is also provided here. A forward tubular body 15 is screwed into the envelope 9 by threads 16. The tubular body 15 encloses a first ignition cap 17 and a firing pin 18 for the cap. The firing pin 18 is provided with a decelerator of the type known in the art which will not be described in greater detail. For therefore actuating the firing pin, there is provided a longitudinally shiftable rod 20 which is activated by an impact member 21 disposed in the nose of the projectile. The rod displays a spheroid surface 20*a* which cooperates with a corresponding cup-shaped surface 21*a* on the impact member.

The tubular body 15 also forms a receptacle for a second ignition cap 22 which is placed ahead of the barrier 5. The ignition cap 22 extends into a central recess 5*a* on the tubular body. The ignition cap 22 is inserted in a retainer 22*a*, 22*b*, the retainer portion 22*a* extending into the recess 5*a* and the retainer portion 22*b* being screwed or fixedly mounted in a corresponding manner in a recess in the tubular body 5. Thus, a natural breakpoint is created in the plane shown by the arrows A extending at right angles to the plane of the FIG. 2. In association with the breakpoint A, there are disposed two splinter charges 23, 24 in the ignition cap, of which the splinter charge 24 abuts against the end surface of the ignition charge of the ignition cap.

The tubular body forming the barrier 5 is designed with a flange 5b whose circumferential surface connects to or is part of the circumferential surface of the projectile. A channel 25 is provided between the ignition caps 17 and 22, by the intermediary of which ignition gases generated by the ignition cap 17 may reach the charges 23, 24 of the ignition cap 22. The tubular body 5 is designed with a central channel 26 by which gases generated by the ignition cap 22 may be led rearwardly to the portion 4 behind the barrier 5.

The portion 4 includes a casing portion 27 which may be of aluminum or equivalent material. The casing portion 27 is screwed into the tubular body by threads 28. Mutually facing ends 5*c* and 27*a* of the portions 5 and 27, respectively, abut against one another by means of a washer 29 of lead or corresponding soft material. The portions 5 and 27 are sealed off by means of a ring 30 of elastic material. The casing portion 27 includes a unit 31, disposed in its forward end, a hollow cylindrical portion 32, a primer 33 and a bottom screw 34 with its associated eye 35 and driver charge 36. The bottom screw 34 is sealed against the casing portion 27 by a sealing ring 37 of elastic material. The casing portion 27 extends into a space 38 in the projectile and the end surface of the driving charge 36 faces the main charge or payload 39 of the projectile. The primer 33 is of known type which includes the charge 33*a*, disposed to be twisted, from the side position illustrated in FIG. 2, to an arming position in register with the eye 35. The casing portion 27 includes a central recess 27*b* in which the hollow cylindrical portion 32 is resiliently suspended in elastic members which, in the present embodiment, are in the form of three O-rings 40, 41 and 42. The hollow cylindrical portion 32 abuts, by its rear end, against a washer 43 of plastic or equivalent material. The O-rings are disposed to damp both axial and radial movements. The hollow cylindrical portion 32 is provided with peripheral annular grooves for the O-rings 40 and 41. The O-ring 42 abuts against an oblique front surface on the hollow cylindrical portion and an inner abutment surface on the casing portion 27.

The hollow cylindrical portion centrally carries a delayed action charge 44 which may be of a type known in the art, the end surface of which opens in a space 45 of a volume of 1–6 $cm^3$, preferably 3–4 $cm^3$.

The unit 31 is provided with a nozzle 31*a*, whose orifice is 0.2–0.6 mm, preferably 0.3–0.4 mm in diameter. The unit also includes a booster charge 46. The inlet opening for the unit is designated 31*b* and is in communication with a space 5*d* in the barrier 5. The unit 31 is operative to deliver, to the space 45, ignition gas for the delayed action charge 44. In this instance, the unit exercises a pressure on the gases which rises at least at the end of the ignition impulse. The unit is arranged so as to lead the gases from the channel 26 but may, thanks to its own booster charge 46, generate its own gases.

The ignition sequence of the projectile is as follows: On impact with a flimsy target, the impact force is sensed by the impact member 21 which shifts the rod 20 longitudinally. The decelerator 19 is released, with the result that the rod 20 actuates the firing pin 18. The firing pin detonates the ignition charge 17 which thereby generates ignition gases which are led out into the channel 25 to the ignition cap 22. This is detonated by these gases and in turn generates gases which are led further through the channel 26 to the unit 31. The unit thereby occasions the effective ignition of the delayed action charge 44. In the way known in the art, for example, U.S. Pat. No. 4,090,450 and GB No. 2,084,304B, the rotation guard in 33 is activated and set such that the primer 33*a* is positioned in register with the eye 35. As a result, the delayed action charge causes ignition of the primer 33*a* which in turn triggers the charges 35 and 36 which finally ignite the main charge 39.

On impact with hard material, the forward portion 3 of the fuse function will be destroyed. In this event, break-up can be expected to take place in the plane A, with the result that the splinter charges 23 and 24 are detonated. This thus entails activation of the cap 22, whereafter the subsequent sequence will be the same as above. Even if break-up does not occur in the plane of division A, the thermal energy generated on impact will detonate the cap so that the intended effect will be that described above.

Ignition caps 17, 22, the units 31 and delayed action charge 44 are selected such that ignition of the main charge takes place after the projectile has pierced the target and penetrated a distance of approximately 1.5–3.0 m. The delayed action is selected in dependence upon the velocity of the projectile and the distance to which the projectile is to penerate into the target before explosion occurs. The construction as described above is suitable primarily for high velocity projectiles.

In FIG. 1, a target has been designated M and the penetration distance to be attained before explosion of the main charge of the projectiles is designated a. When the projectile pierces thick-walled targets, for example 12 mm armour plating, the barrier 5 participates as an effective element in the piercing function.

The present invention should not be considered as limited to that described above and shown on the Drawings, many modifications being conceivable without departing from the spirit and scope of the appended Claims or the inventive concept as herein disclosed.

What we claim and desire to secure by Letters Patent is:

1. A high velocity projectile for penetration of both soft and hard targets and exploding the payload after penetration comprising:

forward and rear portions of a projectile body;

a barrier member made of a high strength material separating said forward and said rear portions, said rear portion including a casing member;

a fuse detonatable on impact with a target and operating either by high sensitivity on impact against soft targets or by delayed action, which allows explosion of the main charge after penetration, said fuse including a delayed action charge, located in said rear portion of said projectile body behind said barrier member thereby being protected against detonation by shock waves produced in the forward portion, said charge being disposed in a hollow cylindrical portion which is resiliently mounted within said casing member by means of elastic annular ring members damping movements of said cylindrical portion in both axial and radial direction; and an effectuating unit disposed between said barrier and said delayed action charge for providing a reliable ignition of said delayed action charge in the detonated state of said projectile.

2. The projectile according to claim 1 wherein said casing member is connected to said barrier member by elastic rings.

3. The projectile according to claim 2, wherein said forward portion, said barrier member and said casing member are made from materials of different hardness which reduce the propagation of the shock waves.

4. The projectile according to claim 3 wherein said casing member is made of aluminum.

5. The projectile as claimed in claim 4, wherein mutually facing end surfaces of said barrier member and said casing member are urged towards each other by means of a resilient ring.

6. The projectile as claimed in claim 5, wherein the rear surface of said hollow cylindrical portion abuts against a washer of plastic material, said washer having a central recess.

7. The projectile as claimed in claim 6, wherein said effectuating unit includes a nozzle discharging into an adjacent space, said space communicating with said delayed action charge, said unit providing through said nozzle a temporally incremental pressure into the space.

8. The projectile as claimed in claim 7, wherein said effectuating unit comprises a charge which boosts the ignition flow obtained from the fuse in said forward portion.

9. The projectile as claimed in claim 8, wherein said fuse includes leading and trailing ignition cap disposed in mutual sequence and ahead of said barrier in said forward portion, an outlet of said leading ignition cap being in communication with an inlet of said trailing ignition cap, an outlet of said trailing ignition cap being in communication with an inlet of said effectuating unit.

10. The projectile as claimed in claim 9, wherein the fuse in said forward portion comprises an impact member which actuates a rod for initiating movement of a firing pin, said impact member having a cup-shaped surface which cooperates with a spherical surface on said rod.

* * * * *

UNITED STATES PATENT AND TRADEMARK OFFICE

CERTIFICATE OF CORRECTION

PATENT NO. : 4,690,057

DATED : September 1, 1987

INVENTOR(S) : Bengt Carlsson

It is certified that error appears in the above-identified patent and that said Letters Patent is hereby corrected as shown below:

Cover sheet, line [75], change "Gengt" to -- Bengt --.

Signed and Sealed this

Second Day of February, 1988

*Attest:*

*Attesting Officer*

DONALD J. QUIGG

*Commissioner of Patents and Trademarks*